US006905001B1

(12) United States Patent
Runciman

(10) Patent No.: US 6,905,001 B1
(45) Date of Patent: Jun. 14, 2005

(54) SOUNDERS FOR FIRE ALARM SYSTEMS

(75) Inventor: Dunstan Walter Runciman, Zeekoeivlei (ZA)

(73) Assignee: GSBS Development Corporation, Charlotte, NC (US)

( * ) Notice: Subject to any disclaimer, the term of this patent is extended or adjusted under 35 U.S.C. 154(b) by 0 days.

(21) Appl. No.: 10/343,549

(22) PCT Filed: May 5, 2000

(86) PCT No.: PCT/ZA00/00091

§ 371 (c)(1),
(2), (4) Date: Dec. 2, 2003

(87) PCT Pub. No.: WO00/69213

PCT Pub. Date: Nov. 16, 2000

(30) Foreign Application Priority Data

May 7, 1999 (ZA) ..... 99/3155

(51) Int. Cl.[7] ..... G10K 11/00
(52) U.S. Cl. ..... 181/188; 181/187

(58) Field of Search ..... 181/188, 175, 181/177–187, 189–197

(56) References Cited

U.S. PATENT DOCUMENTS

| | | | | |
|---|---|---|---|---|
| 1,943,499 A | | 1/1934 | Williams | |
| 2,310,243 A | | 2/1943 | Klipsch | |
| 3,142,353 A | | 7/1964 | Todisco | |
| 3,772,466 A | * | 11/1973 | Hossbach | 381/184 |
| 4,893,343 A | * | 1/1990 | Bader | 381/341 |

* cited by examiner

*Primary Examiner*—Kimberly Lockett
(74) *Attorney, Agent, or Firm*—Baker & Hostetler, LLP

(57) ABSTRACT

A sounder is disclosed which has walling (36, 38) defining a first air column (26) leading to a first sound aperture (34) through which the first column opens to atmosphere, and walling (40, 44) defining a second air column (60) leading to a second aperture (64) through which the second column opens to atmosphere. A diaphragm (16) is between the air columns and means are provided for causing said diaphragm to vibrate.

4 Claims, 3 Drawing Sheets

SOUNDERS FOR FIRE ALARM SYSTEMS

FIELD OF THE INVENTION

This invention relates to sounders for fire alarm systems.

BACKGROUND TO THE INVENTION

Some fire alarm systems have sounders built into the bases which receive the detectors. These are referred to in the industry as "behind detector" sounders. Such sounders are as a consequence usually on the ceiling of the protected area. The specifications of other fire alarm systems require the use of wall mounted sounders. Such sounders are "stand alone" units and do not incorporate detectors.

Most sounders are powered directly off the communication lines and hence the power available is small. As a consequence such sounders must be efficient, and the present invention seeks to provide a sounder which produces acceptable all round sound levels using the power available on the communication lines.

BRIEF DESCRIPTION OF THE INVENTION

According to the present invention there is provided a sounder comprising walling defining a first air column leading to a first sound aperture through which the first column opens to atmosphere, walling defining a second air column leading to a second sound aperture through which the second column opens to atmosphere, a diaphragm between said columns, and means for causing said diaphragm to vibrate.

Preferably said sounder comprises an elongate cavity extending centrally of said sounder, said diaphragm dividing said cavity into first and second parts, said first part, at the end thereof remote from the diaphragm, leading into a re-entrant hom, said first sound aperture being in the form of a circumferentially extending aperture.

In the preferred form said re-entrant horn preferably has a first hairpin bend therein adjacent said end of said elongate cavity, said bend placing said cavity in communication with a reflex section lying adjacent said elongate cavity, a second hairpin bend, the second bend placing the end of said section remote from the first hairpin bend in communication with an outlet section of said hom which section itself leads to said circumferentially extending sound aperture.

The end of the second part of the central cavity remote from the diaphragm preferably splits into a plurality of passages, there being a right angled bend in each passage whereby the passages extend radially outwardly from said elongate cavity to sound apertures which open radially outwardly. There are, in the preferred form, six passages which are equally spaced circumferentially of the elongate cavity.

To optimize sound output the difference between the length of the first column and the length of the second column is substantially equal to half a wavelength at the frequency at which the diaphragm vibrates.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
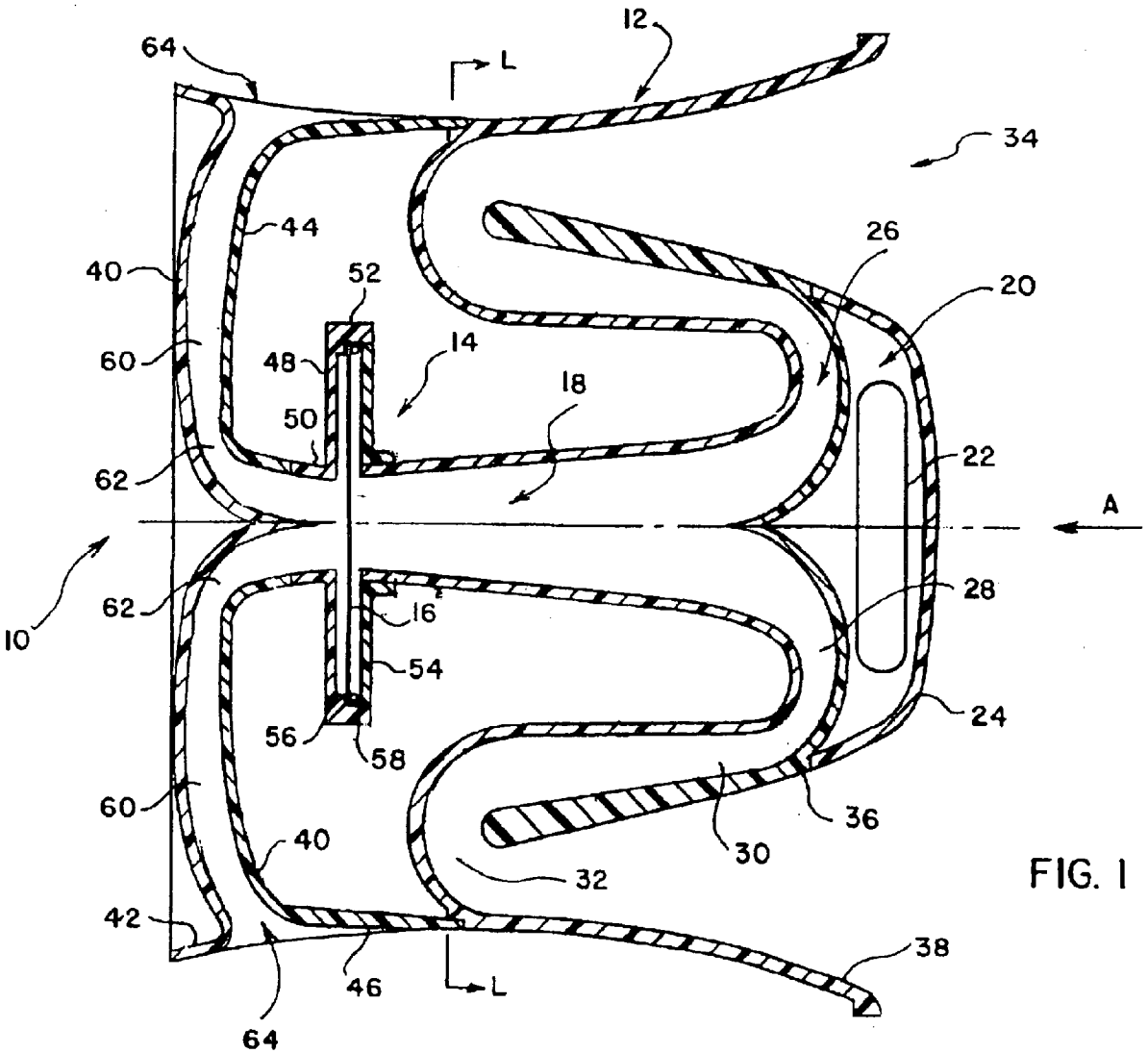
FIG. 1 is an axial section through a wall mounted sounder.
Figure 2:
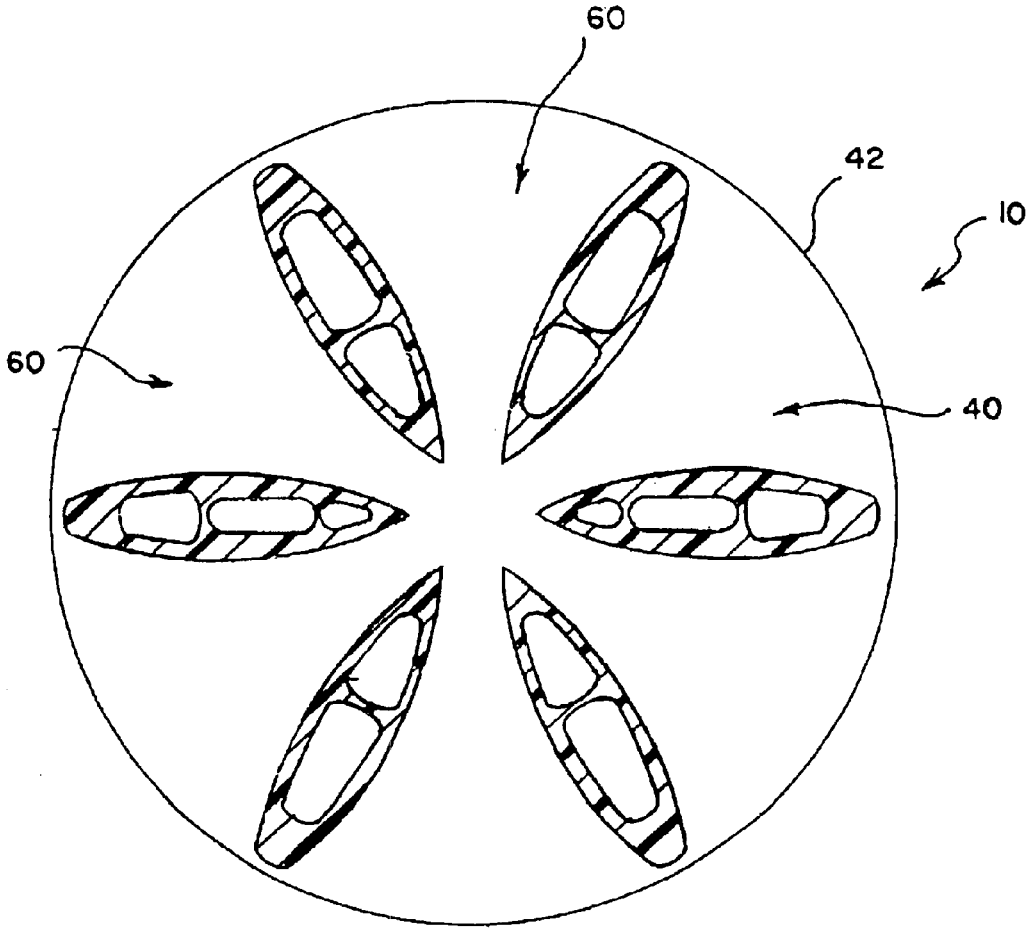
FIG. 2 is a view of a base part of the sounder.

The sounder illustrated comprises a base part 10 with means (not shown) for fixing it to a wall and a horn part 12. Between the parts 10 and 12 there is a unit 14 containing a diaphragm 16. An elongate central cavity 18 extends from the base part 10 to the underside of a space 20 which receives a lamp 22. The space 20 is closed by a transparent cover 24.

The cavity 18 joins, just underneath the space 20, a tortuous passage 26 which constitutes a reflex hom. The hom is circular in front elevation.

The passage 26 has a first hairpin bend 28 therein, the bend 28 reversing the direction of the passage 26 thereby providing an intermediate reflex passage section 30 which extends in the direction away from the space 20. A second hairpin bend 32 reverses the direction of the passage 28 again. The bends 28 and 32 form the ends of the section 30.

Beyond the bend 32 there is a sound aperture 34 which opens to atmosphere in the direction away from the base part 10. The sound aperture 34, when the sounder is viewed in the direction of arrow A, is essentially circular in configuration and is bounded by an inner circular wall 36 and an outer circular wall 38.

The line along which the parts 10 and 12 join along their outer peripheries is designated L. The part 10 comprises a web 40 of disc-like form with a flange 42 around the periphery thereof and a web 44 of dish-like form with a flange 46 around the periphery thereof.

The unit 14 comprises a circular casing having a base wall 48, a short hollow sleeve 50 protruding from the base wall, and a peripheral wall 52 protruding from the base wall 48 in the opposite direction to the sleeve. A lid 54 closes off the space which receives the diaphragm 16. The lid has an opening in it which communicates with the part of the cavity 18 to the right of the unit 14 as the sounder as illustrated in FIG. 1. The periphery of the diaphragm 16 is between a circumferential rib 56 which stands proud of the base wall 48 and an O-ring 58 which is placed in the unit 14 before the lid 54 is pressed into place.

The end of the part of the central cavity 18 to the left of the unit 14 splits into six passages. Two of the passages, designated 60, are shown in FIG. 1. Each passage 60 has a right angled bend 62 therein and opens to atmosphere generally radially of the sounder, that is, parallel to the wall on which the sounder is mounted.

The sound aperture at the end of each passage 60 is designated 64.

It will be noted that the diaphragm 16 divides the airways of the sounder into two separate sections. The impedance of the columns of air between the diaphragm 16 and the outlets 34 and 64 respectively are optimized acoustically to provide the requisite sound distribution between the reflex horn and the passages 60. This is achieved by making the difference in length between the column of air extending from the diaphragm 16 to the outlet 34 and the column of air extending from the diaphragm 16 to the outlet 64 equal to one half a wavelength at the frequency at which the diaphragm vibrates. If this relationship is not adhered to the sound levels decrease due to destructive interference between the sound sources represented by the outlets 34 and 64.

Figure 3:
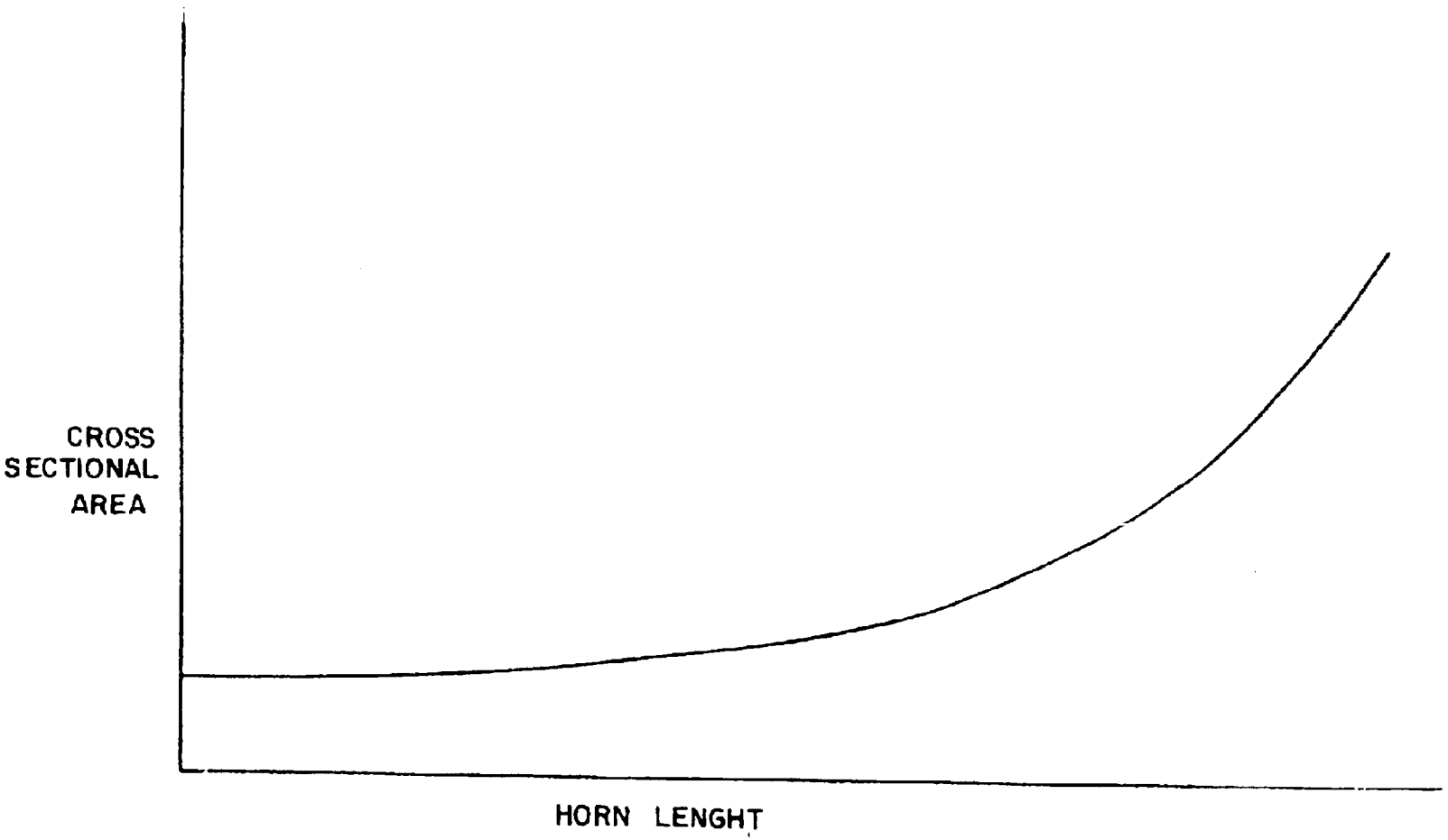
FIG. 3 is a graph illustrating the configuration of a hom.

Each horn passage 26 and each hom passage 60 is bounded by a shown in FIG. 3. This plots the length of the horn area of the horn. It will be seen that the area of the horn with distance from the diaphragm 16.

What is claimed is:

1. A sounder comprising walling defining a first air column leading to a first sound aperture through which the first column opens to atmosphere, walling defining a second air column leading to a second sound aperture through which the second column opens to atmosphere, a diaphragm between said columns, and means for causing said diaphragm to vibrate, and including an elongate cavity extending centrally of said sounder, said diaphragm dividing said cavity into first and second parts said first part, at the end thereof remote from the diaphragm, leading into a re-entrant horn, said first sound aperture being in the form of a circumferentially extending aperture, wherein said re-entrant horn has a first hairpin bend therein adjacent said end of said elongate cavity, said bend placing said cavity in communication with a reflex section lying adjacent said elongate cavity, a second hairpin bend, the second bend placing the end of said section remote from the first hairpin bend in communication with an outlet section of said horn which section itself leads to said circumferentially extending sound aperture.

2. A sounder comprising walling defining a first air column leading to a first sound aperture through which the first column opens to atmosphere, walling defining a second air column leading to a second sound aperture through which the second column opens to atmosphere, a diaphragm between said columns, and means for causing said diaphragm to vibrate, and including an elongate cavity extending centrally of said sounder, said diaphragm dividing said cavity into first and second parts, said first part, at the end thereof remote from the diaphragm, leading into a re-entrant hom, said first sound aperture being in the form of a circumferentially extending aperture, wherein an end of the second part of the central cavity remote from the diaphragm splits into a plurality of passages, there being a right angled bend in each passage whereby the passages extend radially outwardly from said elongate cavity to sound apertures which open radially outwardly.

3. A sounder according to claim 2 and including six passages which are equally spaced circumferentially of the elongate cavity.

4. A sounder comprising walling defining a first air column leading to a first sound aperture through which the first column opens to atmosphere, walling defining a second air column leading to a second sound aperture through which the second column opens to atmosphere, a diaphragm between said columns, and means for causing said diaphragm to vibrate, wherein the difference between the length of the first air column and the length of the second air column is substantially equal to half a wavelength at the frequency at which the diaphragm vibrates.

* * * * *